US009205491B2

(12) United States Patent
Goettsch et al.

(10) Patent No.: US 9,205,491 B2
(45) Date of Patent: Dec. 8, 2015

(54) METAL POURING METHOD FOR THE DIE CASTING PROCESS

(71) Applicant: GM Global Technology Operations LLC, Detroit, MI (US)

(72) Inventors: David D. Goettsch, Shelby Township, MI (US); Brad A. Ohlrich, Bloomington, IN (US)

(73) Assignee: GM Global Technology Operations LLC, Detroit, MI (US)

( * ) Notice: Subject to any disclaimer, the term of this patent is extended or adjusted under 35 U.S.C. 154(b) by 209 days.

(21) Appl. No.: 14/159,866

(22) Filed: Jan. 21, 2014

(65) Prior Publication Data

US 2015/0202685 A1 Jul. 23, 2015

(51) Int. Cl.

| | |
|---|---|
| ***B22D 17/30*** | (2006.01) |
| ***B22D 41/04*** | (2006.01) |
| ***B22D 17/00*** | (2006.01) |
| ***B22D 17/20*** | (2006.01) |

(52) U.S. Cl.

CPC ..... *B22D 41/04* (2013.01); *B22D 17/00* (2013.01); *B22D 17/2023* (2013.01); *B22D 17/30* (2013.01)

(58) Field of Classification Search

CPC ..... B22D 17/30; B22D 41/04

USPC ..... 164/113, 136, 335–337

See application file for complete search history.

(56) References Cited

U.S. PATENT DOCUMENTS

| | | | | |
|---|---|---|---|---|
| 5,472,173 | A * | 12/1995 | Laszlo | B22D 41/04 266/227 |
| 8,327,912 | B2 * | 12/2012 | Terada | B22D 41/06 164/136 |
| 8,522,857 | B2 | 9/2013 | Goettsch et al. | |

* cited by examiner

*Primary Examiner* — Kevin E Yoon

(74) *Attorney, Agent, or Firm* — Dinsmore & Shohl LLP

(57) ABSTRACT

A method for delivering molten metal from a ladle to a die casting shot sleeve and a ladle and shot sleeve assembly. Both the ladle and a rotatable device coupled to the shot sleeve are made to rotate about respective axes as a way to reduce air entrainment and oxide film inclusions during the gravity filling of the shot sleeve with molten metal from the ladle. In a preferred form, the axis of rotation of the nozzle in the ladle is orthogonal to the axis of rotation of the shot sleeve rotatable device that is preferably placed in a horizontal filling direction. The nozzle is configured to deliver the molten metal through the lowest level of the shot sleeve when the ladle is rotated from a first position to a second position about its axis, followed by its rotation about a filling axis of the shot sleeve from a first angular position to a second angular position. At the second angular position, a die casting plunger can fill the casting cavity with the molten metal that has been delivered to the shot sleeve.

20 Claims, 4 Drawing Sheets

METAL POURING METHOD FOR THE DIE CASTING PROCESS

BACKGROUND TO THE INVENTION

This invention relates generally to an improved way to pour molten metal used in a casting operation, and more particularly to minimize the metal damage due to filling of shot sleeve of a horizontal high pressure die casting machine by using bottom filling of the shot sleeve combined with sequential rotation of a pouring ladle and the shot sleeve.

Low process cost, close dimensional tolerances (near-net-shape) and smooth surface finishes are all desirable attributes that make high pressure die casting (HPDC) a widely used process for the mass production of metal components. By way of example, manufacturers in the automobile industry use HPDC to produce near-net-shape aluminum alloy castings for engine and transmission components. In a typical HPDC process, molten metal is introduced into shaped mold cavities through two metal transfer steps: a (first) low pressure tilt pour from a ladle to a filler tube (called a shot sleeve), and a (second) high pressure injection (such as upon movement of a piston in the tube) into the gating/casting cavity.

Aluminum alloy castings are sensitive to molten metal delivery speed. When the delivery speed is too low, misruns and cold shuts may result; when it is too high, turbulent flow can entrap air or other gases that can in turn lead to oxide formations, as well as form surface molten aluminum that oxidizes when it comes in contact with ambient air. Both forms of oxides are commonly referred to as dross. The concern over higher speed HPDC operations—while more efficient for large-scale production than their low-speed counterparts—is particularly acute considering that the high velocities are an inherent part of the higher delivery pressures. Both the entrapped (i.e., bi-film) and surface (i.e., top-layer) dross mix and subsequently solidify with the rest of the molten metal, which in turn leads to inclusions and highly porous regions that adversely impact structural and mechanical properties of the cast component.

Research has shown that the entrained air (i.e., bi-film) variant of dross can arise if the velocity of the liquid metal is sufficiently high, and that such a velocity is believed to be between 0.45 m/s and 0.5 m/s for Al, Mg, Ti and Fe alloys. See, for example, Campbell, Castings (Elsevier Butterworth-Heinemann, 2003). Thus, it is desirable to keep metal delivery speeds under this critical velocity to significantly reduce the number of oxides being formed in the casting. U.S. Pat. No. 8,522,857—which is owned by the Assignee of the present invention and incorporated herein in its entirety by reference—evidences additional research that correlates the delivery location of the molten metal from the ladle to significant reductions in turbulence and other dross-inducing events. That approach employed a side-pour ladle configuration that takes advantage of the fact that metal at the bottom of the ladle is substantially free from dross and other foreign material, as well as eliminates the exposed plunging metal stream during pour basin filling. Such a ladle design has been shown minimize turbulence in ways not possible with traditional tilt-pour molding processes. Nevertheless, additional innovations are needed to take full advantage of a side pour ladle used in the filling of an HPDC shot sleeve.

SUMMARY OF THE INVENTION

It is against the above background that embodiments of the present invention generally relate to methods to reduce the air entrainment and oxide film inclusions due to the gravity filling of a horizontal die casting shot sleeve. According to a first aspect of the present invention, a method of transferring molten metal to a die casting shot sleeve includes providing a molten metal-filled ladle with an outlet orifice (such as a dispensing nozzle) such that the nozzle or orifice defines a first axis of rotation about a molten metal flow direction formed through the nozzle. A receptacle is placed fluidly downstream of the ladle and is oriented relative to the ladle such that it defines a second axis of rotation. Upon establishing a fluid coupling between the ladle and the receptacle though the nozzle, the molten metal present in the ladle is delivered to the receptacle by rotating the ladle about the first axis of rotation, after which the receptacle is rotated about the second axis of rotation to permit the remainder of the molten metal that can fit within a cavity, flow path or related compartment within the receptacle to be introduced therein. After these two separate rotations, the molten metal that has been delivered to and through the receptacle is conveyed via shot sleeve into a fluidly-coupled mold cavity with a significant reduction in dross-forming turbulence.

According to another aspect of the present invention, a method of transferring molten metal to a die casting mold includes providing a ladle with a dispensing nozzle that defines a first axis of rotation. Likewise, a receptacle is fluidly placed between the ladle and the mold and oriented relative to the ladle such that a rotatable joint fluidly coupled to the receptacle defines a second axis of rotation. The ladle is fluidly coupled to the receptacle though the nozzle and the rotatable joint such that a first portion of the molten metal contained in the ladle is delivered to the receptacle by rotating the ladle about the first axis of rotation. After this, a second portion of the molten metal is delivered from the ladle to the receptacle by rotating the rotatable joint about the second axis of rotation, after which the molten metal that has been delivered to the receptacle is conveyed to a mold cavity that forms a part of the mold that is placed in fluid communication with the receptacle.

According to yet another aspect of the present invention, a method of transferring molten metal to a die casting mold includes placing molten metal within a ladle that is configured to rotate about a first axis of rotation. A receptacle is fluidly placed between the ladle and the mold so that a rotatable joint that is coupled with (or part of) the receptacle defines a second axis of rotation. From this, the ladle is fluidly coupled to the receptacle though the rotatable joint such that a first portion of the molten metal from the ladle is delivered to the receptacle along a substantially horizontal molten metal delivery path by rotating the ladle about the first axis of rotation, after which a second portion of the molten metal is delivered along a substantially vertical molten metal delivery path by rotating the rotatable joint about the second axis of rotation. During this second delivery, the rigid fluid coupling between the ladle and the rotating joint facilitates planetary movement of the ladle about the second axis of rotation. After this, the molten metal that has been delivered to the receptacle is conveyed to the mold.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
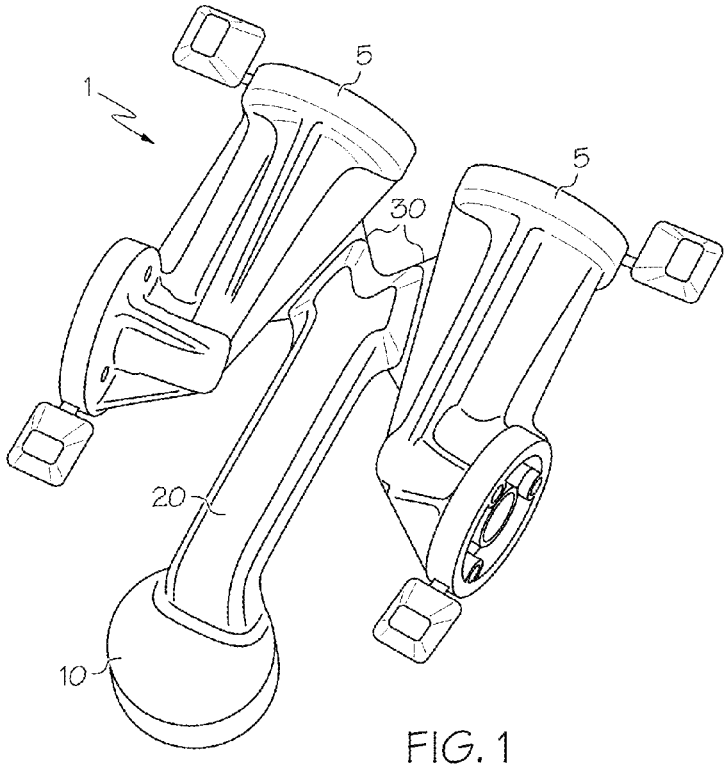
FIG. 1 (PRIOR ART)
FIG. 1 is a simplified view of a gating system according to the prior art.

Referring first to FIG. 1, in one form of HPDC, a network of fluidly connected channels may be used to convey the molten material to the mold cavities; such a network is commonly referred to as a gating (or charging) system 1. In the figure, the notional component that corresponds to the depicted shot design being produced is a two-cavity automotive oil filter adapter 5, although it will be appreciated by those skilled in the art that any other component compatible with HPDC manufacturing could also be shown without detracting from the nature of the present invention. Among other components, the gating system 1 may include the end of the shot sleeve biscuit 10, a runner 20 and casting cavity gates 30.

Figure 2:
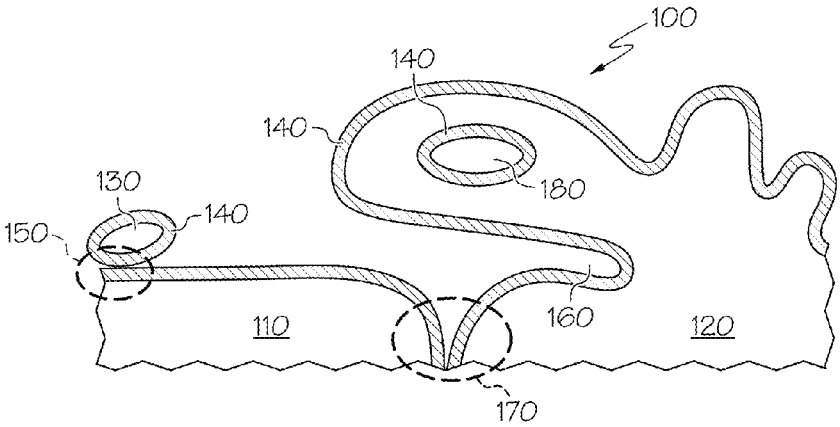
FIG. 2 (PRIOR ART)
FIG. 2 shows a representative bi-film produced by turbulence of the prior art.

Referring next to FIG. 2, multiple forms of defects in an aluminum alloy are shown. Upon heating into liquid (i.e., molten) form 100, various streams of aluminum (for example, first stream 110 and second stream 120, as well as droplets 130) interact in varied ways. When processed in an oxygen-containing environment, oxide films 140 may form on the outer surface of the liquid aluminum, including the first stream 110, second stream 120 and droplets 130. A bi-film 170 forms when the two oxide films 140 from respective first stream 110 and second stream 120 meet. Bi-films also form when turbulence-induced droplets land on the metal stream, as shown at 150. While bi-films 150, 170 are an inherent part of almost every casting process, they are generally not detrimental to casting mechanical properties unless the oxide film 140 is entrained in the bulk of the alloy, as shown at location 160 due to the folding action when two separate streams, first stream 110 and second stream 120, meet at large angles (typically more than 135 degrees, where the splashing action of one stream collapses onto another stream to form a cavity therebetween). Such a formation can have significant impacts on overall material integrity and subsequent casting scrap rates. Likewise, entrained gas 180 may form from the pouring action of liquid metal, creating additional entrained oxides. As mentioned above, when liquid metal is poured or forced into a mold or shot sleeve in a conventional manner, it is possible to trap large gas bubbles.

Figure 3A:
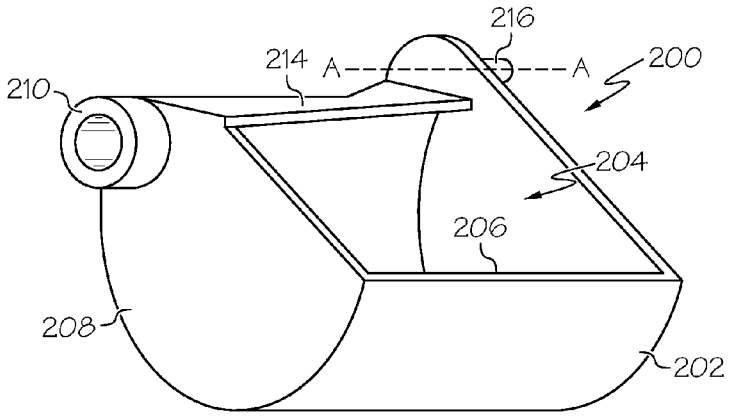
FIGS. 3A and 3B show perspective views of a side-pour ladle in two different angular orientations about its eccentric pouring axis of rotation.
Figure 3B:
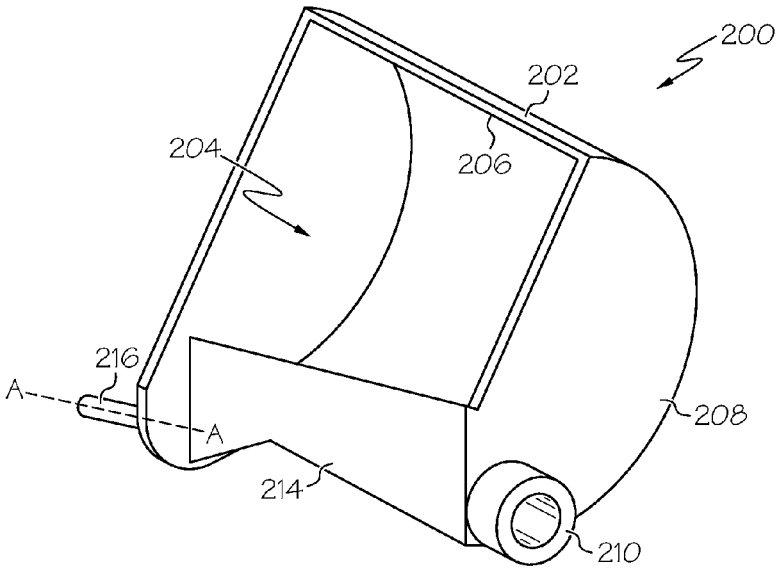

Referring next to FIGS. 3A and 3B, a ladle 200 includes a main body 202, hollow interior 204 and an opening 206 for receiving molten metal 100. The opening 206 has a size that accommodates a dipping operation (such as into a crucible, dip well or related device) while permitting the ladle 200 to hold a sufficient quantity of the molten metal 100 in the hollow interior 204 during transport. For example, the opening 206 may be a substantially open top used for filling the hollow interior 204 with the molten metal 100. As a non-limiting example, the main body 202 may be in the form of a partial cylinder with capped ends. Other shapes for the main body 202 may also be used, as desired.

The main body 202 has a sidewall 208 with a nozzle 210 formed therein. In one form, the nozzle 210 may be integral with the sidewall 208 the main body 202. The nozzle 210 is adapted to rotate together with the main body 202. The nozzle 210 defines a first axis of rotation A for the main body 202 about pin 216 that is formed thereon. A funnel panel (not shown) forms part of a rear wall 214 of the portion of the main body 202 that is adjacent a pour nozzle 210 and may be used to help direct the molten metal 100 toward the nozzle 210 when the ladle 200 is rotated to the second position of FIG. 3B. An orientation of the rear wall 214 may be such that it is angled downwardly when the main body 202 is rotated to the second position about the axis of rotation A, as shown in FIG. 3B. Furthermore, the axis of rotation A defined by the nozzle 210 is preferably offset from a longitudinal axis of the main body 202 such that rotary movement about the axis of rotation A is eccentric relative to the longitudinal axis of the main body 202. The offset allows a side of the main body 202 opposite the nozzle 210 to lift up and angle a flow of molten metal 100 to the nozzle 210 when the main body 202 is in the second position. As with the funnel panel, the angled rear wall 214 may thereby direct the molten metal 100 toward the nozzle 210 when the ladle 200 is rotated about axis A from the first position of FIG. 3A to the second position of FIG. 3B.

Figure 4A:
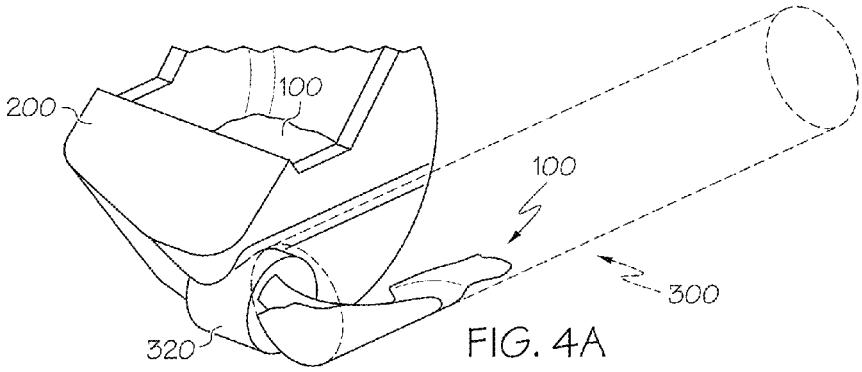
FIGS. 4A through 4C show sequential steps in delivering molten metal from the ladle of FIGS. 3A and 3B to a shot sleeve according to an aspect of the present invention.
Figure 4B:
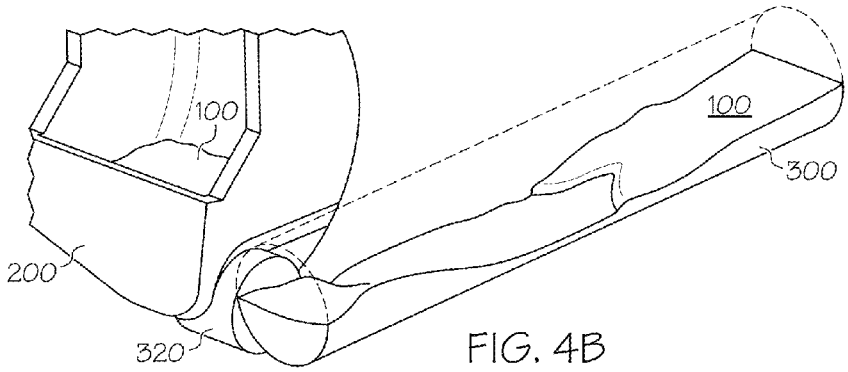
Figure 4C:
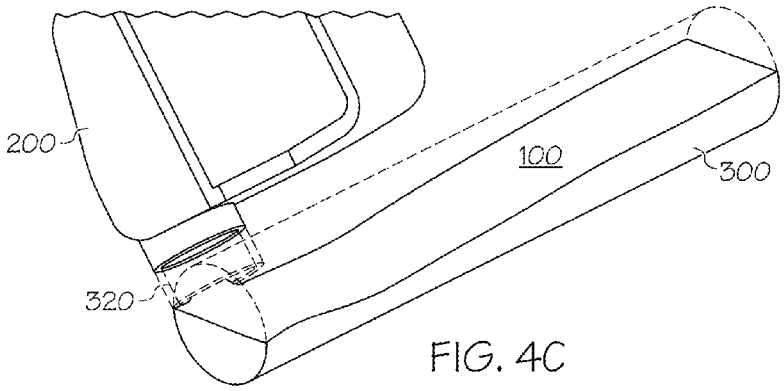

Referring next to FIGS. 4A through 4C, the side-pour ladle configuration of FIGS. 3A and 3B is augmented by having a fluid delivery path to the shot sleeve, runner or related fluid-conveying receptacle 300 rotate about a second axis of rotation (also referred to herein as a flow axis of rotation) F after the ladle 200 has been rotated about its first axis of rotation A. In this way, the substantially horizontal delivery of the molten metal 100 from the nozzle 210 to the shot sleeve 300 takes place as a way to reduce the turbulent effects of a conventional vertical delivery; such an arrangement promotes low pressure/low velocity molten metal 100 delivery. Thus, using the present approach, the molten metal 100 may be contact poured at the lowest point of the shot sleeve 300 and then have a greatly reduced amount of molten metal from ladle 200 be subject to rotation for delivery into the confined environment of the shot sleeve 300 so that a rotating joint or fill cap that make up the sleeve inlet (discussed in more detail below) through rotational movement of one or more of the cap or joint to be at or near the top surface of the shot sleeve 300. This allows a bottom fill system; significantly, the recommended metal fill velocity is kept very low in the present system (preferably below 0.5 m/s).

In operation, the rotation of the ladle 200 and the shot sleeve 300 takes place sequentially. Ladle 200 is rotatable about the first axis of rotation A to deliver the molten metal 100 from the nozzle 210 into a generally cylindrical hollow fill path or cavity 310 of the shot sleeve 300 when the ladle 200 is rotated from the first position (shown in FIG. 3A) to the second position (shown in FIG. 3B). Fluid coupling of the ladle 200 and shot sleeve 300 is achieved by a closed coupling to reduce spillage and inadvertent contact of the poured molten metal 100 with the ambient atmosphere. Sealing or related means (such as by a gasket or the like, not shown) may be used to provide additional isolation of the nozzle-to-receptacle flow path from the ambient environment. The second (i.e., pouring) position of the ladle 200 in FIG. 3B is replicated in FIGS. 4A and 4B the latter of which shows a fill path of the shot sleeve 300 being filled with molten metal 100. The eccentricity of the ladle 200 fills the shot sleeve 300 from the lowest point of the ladle 200 along a substantially horizontal filling direction, eliminating the metal fall associated with vertical or related gravity pour systems.

Figure 5A:
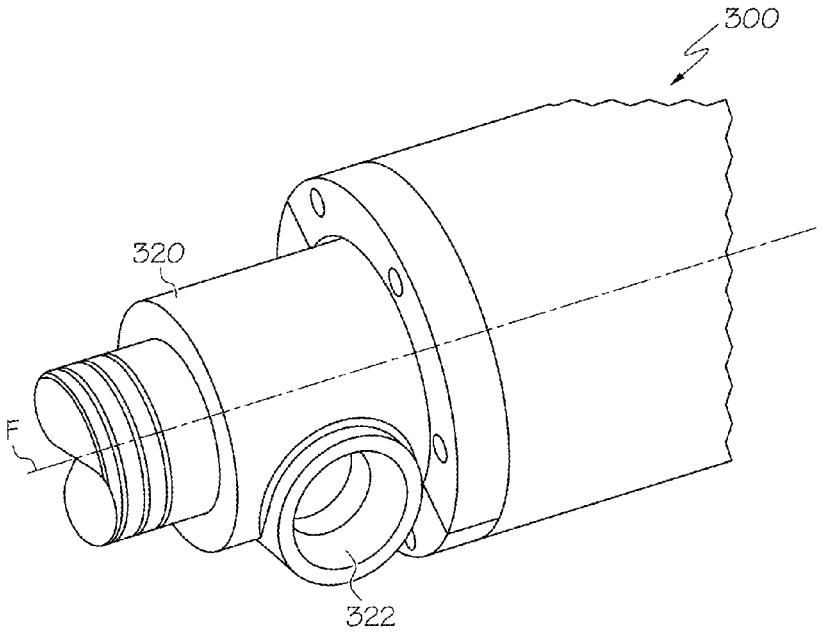
FIGS. 5A and 5B show perspective views of a fill cap in two different angular orientations about a flow axis of rotation of the shot sleeve of FIGS. 4A through 4C.
Figure 5B:
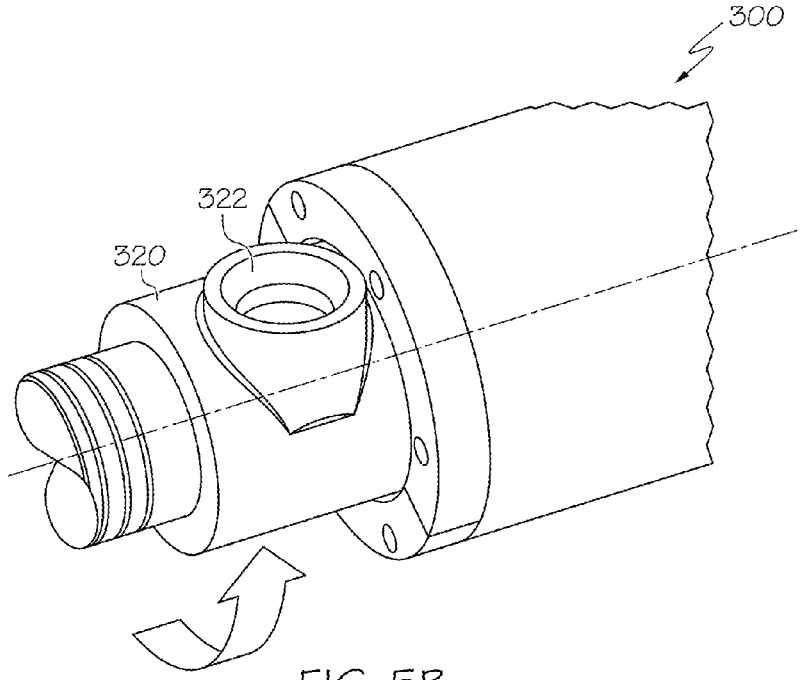

Referring next to FIGS. 5A and 5B in conjunction with FIG. 4C, the present invention involves rotation about two orthogonal degree-of-freedom axes A and F. To do this, a coupling system in the form of a rotatable fill cap 320 that serves as an inlet for shot sleeve 300 is shown. In one form, the fill cap 320 is made of H13 steel and is configured as a rotatable joint in that it forms a secure, substantially leak-free connection between the ladle 200 and shot sleeve 300 while also permitting rotation about the second axis of rotation F. While at least some molten metal 100 is still flowing substantially horizontally from the nozzle 210 of ladle 200, both the ladle 200 and the rotatable fill cap 320 (which are rigidly affixed to one another through a coupling (for example, clamped, threaded, male-female or the like to promote robust containment or sealing across the joint) are pivotably moved about the second axis of rotation F as shown with particularity in FIG. 4C. An inlet orifice 322 formed in rotatable fill cap 320 is raised above the metal level within the fill path 310 of shot sleeve 300 by rotating the assembled connection between the ladle 200 and shot sleeve 300. In one form, the fill cap 320 rotates about 90 degrees along the second axis of rotation F from a substantially horizontal orientation to a substantially vertical one. This finishes the draining of the molten metal 100 in ladle 200 and positions the inlet orifice 322 to the top (i.e., vertical) surface position within shot sleeve 300. Although rotating the entire shot sleeve is generally not feasible for larger systems (where, for example, the shot sleeve holds 40 pounds of molten aluminum and involves cavity pressures of up to about 14,000 psi), HPDC activities with low casting weights, shot tip velocities and cavity pressures may be used such that the entire shot sleeve (rather than just the fill cap 320 that is presently shown) could be rotated. Such a configuration may also be made compatible with the side-pouring ladle 200.

Thus, the use of a rotatable joint 320 promotes ease of robotic manipulation of the ladle 200 relative to having to rotate the entire shot sleeve 300 as a way to simplify the delivery of molten metal 100 to an existing die cast machine. Significantly, the pouring efficiency of a conventional tilt ladle pour process is preserved while minimizing the formation of turbulence of the molten metal 100 during both the initial horizontal introduction into the shot sleeve 300, as well as upon the subsequent rotation of the ladle 200. Importantly, the method of the present invention also reduces initial metal stream surface area and oxide film formation.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. Moreover, the term "substantially" is utilized herein to represent the inherent degree of uncertainty that may be attributed to any quantitative comparison, value, measurement, or other representation. As such, it may represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of transferring molten metal to a die casting mold, the method comprising:

providing a ladle with a dispensing nozzle formed therein, said nozzle defining a first axis of rotation about a molten metal flow direction formed therethrough;

providing a receptacle fluidly between said ladle and said mold, said receptacle oriented relative to said ladle such that it defines a second axis of rotation;

fluidly coupling said ladle to said receptacle though said nozzle;

delivering said molten metal from said ladle to said receptacle by rotating said ladle about said first axis of rotation during an initial filling operation of said receptacle, then rotating said ladle about said second axis of rotation to permit subsequent filling of said receptacle; and conveying said molten metal that has been delivered to said receptacle into a mold cavity that is placed in fluid communication therewith.

2. The method of claim 1, wherein said receptacle defines a substantially cylindrical fillpath formed therein.

3. The method of claim 1, wherein said receptacle comprises a fill cap fluidly situated between said nozzle and a shot sleeve, wherein said fill cap is independently rotatable about said second axis of rotation relative to said shot sleeve.

4. The method of claim 3, wherein said fill cap is disposed substantially on one axial end of said shot sleeve.

5. The method of claim 3, wherein said fill cap forms a rotatable joint such that said rotating said ladle about said second axis of rotation takes place through said rotatable joint.

6. The method of claim 5, further comprising fluidly coupling said rotatable joint to said ladle such that exposure of said molten metal to an ambient atmosphere is substantially precluded during said delivering said molten metal from said ladle to said shot sleeve.

7. The method of claim 5, wherein said delivering that takes place during said initial filling operation is introduced into said rotatable joint in a substantially horizontal orientation through an orifice formed therein.

8. The method of claim 7, wherein said delivering that takes place during said subsequent filling operation is introduced into said rotatable joint in a substantially vertical orientation through said orifice.

9. The method of claim 3, wherein molten metal-accepting cavities formed in said fill cap and said shot sleeve define said receptacle.

10. The method of claim 9, wherein said shot sleeve is oriented in a substantially horizontal direction along its fill path.

11. The method of claim 1, wherein procession about said first axis of rotation and said second axis of rotation take place substantially orthogonal to one another.

12. The method of claim 1, wherein movement about said first axis of rotation and said second axis of rotation is robotically controlled.

13. The method of claim 1, wherein said delivering that takes place during said initial filling operation is introduced into said receptacle in a substantially horizontal orientation.

14. The method of claim 1, wherein said delivering that takes place during said subsequent filling operation is introduced into said receptacle in a substantially vertical orientation.

15. A method of transferring molten metal to a die casting mold, the method comprising:

providing a ladle with a dispensing nozzle formed therein, said nozzle defining a first axis of rotation about a molten metal flow direction formed therethrough;

providing a receptacle fluidly between said ladle and said mold, said receptacle oriented relative to said ladle such that a rotatable joint fluidly coupled thereto defines a second axis of rotation;

fluidly coupling said ladle to said receptacle though said nozzle and said rotatable joint;

collecting said molten metal in said ladle;

delivering a first portion of said molten metal from said ladle to said receptacle by rotating said ladle about said first axis of rotation;

delivering a second portion of said molten metal from said ladle to said receptacle by rotating said rotatable joint about said second axis of rotation; and conveying said molten metal that has been delivered to said receptacle into a mold cavity that is placed in fluid communication therewith.

16. The method of claim 15, wherein said first portion of said molten metal is delivered to said receptacle along a substantially horizontal flow direction of said molten metal, and wherein said second portion of said molten metal is delivered to said receptacle along a substantially vertical flow direction of said molten metal.

17. The method of claim 15, wherein procession about said first axis of rotation and said second axis of rotation take place substantially orthogonal to one another.

18. The method of claim 15, wherein said receptacle comprises a fill cap fluidly situated substantially at a molten metal-receiving end of a shot sleeve.

19. A method of transferring molten metal to a die casting mold, the method comprising:

placing molten metal within a ladle that is configured to rotate about a first axis of rotation;

providing a receptacle fluidly between said ladle and said mold, said receptacle comprising a rotatable joint that defines a second axis of rotation;

fluidly coupling said ladle to said receptacle though said rotatable joint;

delivering a first portion of said molten metal from said ladle to said receptacle along a substantially horizontal molten metal delivery path by rotating said ladle about said first axis of rotation;

delivering a second portion of said molten metal along a substantially vertical molten metal delivery path by rotating said rotatable joint about said second axis of rotation; and conveying said molten metal that has been delivered to said receptacle into a mold cavity that is placed in fluid communication therewith.

20. The method of claim 19, wherein procession about said first axis of rotation and said second axis of rotation take place substantially orthogonal to one another.

* * * * *